US009038775B2

(12) United States Patent
Durkin

(10) Patent No.: US 9,038,775 B2
(45) Date of Patent: May 26, 2015

(54) LADDERWAY SYSTEM FOR UNDERGROUND RAISES

(75) Inventor: Steven Peter Durkin, Mandurang (AU)

(73) Assignee: HIRAM (WA) PTY LTD, Victoria (AU)

( * ) Notice: Subject to any disclaimer, the term of this patent is extended or adjusted under 35 U.S.C. 154(b) by 126 days.

(21) Appl. No.: 13/521,575

(22) PCT Filed: Dec. 24, 2010

(86) PCT No.: PCT/AU2010/001753

§ 371 (c)(1),
(2), (4) Date: Jul. 11, 2012

(87) PCT Pub. No.: WO2011/085431

PCT Pub. Date: Jul. 21, 2011

(65) Prior Publication Data

US 2012/0285771 A1 Nov. 15, 2012

(30) Foreign Application Priority Data

Jan. 13, 2010 (AU) ..... 2010900116
Jun. 23, 2010 (AU) ..... 2010902768

(51) Int. Cl.

| | |
|---|---|
| ***A62B 1/20*** | (2006.01) |
| ***E06C 1/28*** | (2006.01) |
| ***E06C 7/08*** | (2006.01) |
| ***E02D 29/12*** | (2006.01) |
| ***E06C 1/38*** | (2006.01) |
| ***E06C 9/02*** | (2006.01) |
| ***E21D 5/00*** | (2006.01) |
| ***E21F 11/00*** | (2006.01) |

(52) U.S. Cl.

CPC . *E06C 1/28* (2013.01); *E06C 7/084* (2013.01); *E02D 29/12* (2013.01); *E06C 1/38* (2013.01); *E06C 9/02* (2013.01); *E21D 5/00* (2013.01); *E21F 11/00* (2013.01)

(58) Field of Classification Search

CPC ..... E06C 1/26; E06C 7/084; E06C 7/085; E06C 7/181; E06C 7/183; E06C 7/185
USPC ..... 182/49, 82, 93, 106, 194; 52/182, 19, 52/20, 21, 169.7, 107, 848, 844, 845; 403/13, 14; 285/9.2, 148.22, 148.27
See application file for complete search history.

(56) References Cited

U.S. PATENT DOCUMENTS

| | | | | |
|---|---|---|---|---|
| 994,133 | A * | 6/1911 | De Jonge | 52/182 |
| 3,381,775 | A * | 5/1968 | Livers | 182/228.2 |
| 3,455,414 | A | 7/1969 | Higgins | |

(Continued)

FOREIGN PATENT DOCUMENTS

| | | |
|---|---|---|
| DE | 19808144 | 9/1999 |
| JP | 2000-303774 | 10/2000 |

(Continued)

*Primary Examiner* — Katherine Mitchell
*Assistant Examiner* — Shiref Mekhaeil
(74) *Attorney, Agent, or Firm* — Hamre, Schumann, Mueller & Larson, P.C.

(57) ABSTRACT

An improved ladderway system 30 for an underground raise. The system comprises an elongate tube 32 made of a suitably rigid plastics material and adapted to be received in the raise. The tube has a series of steps 34 moulded into an interior side wall thereof so as to form a ladder extending substantially the full length of the tube 32.

8 Claims, 7 Drawing Sheets

(56) References Cited

U.S. PATENT DOCUMENTS

| | | | | |
|---|---|---|---|---|
| 3,618,702 | A | 11/1971 | Hendrix et al. | |
| 3,745,738 | A | 7/1973 | Singer | |
| 3,786,899 | A * | 1/1974 | Zenhausern | 182/93 |
| 4,080,713 | A * | 3/1978 | Reid | 29/469.5 |
| 4,524,848 | A | 6/1985 | Russo | |
| 4,660,334 | A | 4/1987 | McCarthy | |
| 4,719,989 | A * | 1/1988 | Ritten | 182/93 |
| 4,991,690 | A | 2/1991 | Woller | |
| 5,323,874 | A * | 6/1994 | Warren et al. | 182/129 |
| 5,398,477 | A * | 3/1995 | Philipp et al. | 52/848 |
| 5,901,506 | A * | 5/1999 | Zicaro et al. | 52/20 |
| 5,931,258 | A * | 8/1999 | Lorentz | 182/93 |
| 6,202,787 | B1 * | 3/2001 | Kessler et al. | 182/106 |
| 6,399,881 | B2 * | 6/2002 | Edelstein | 174/45 R |
| 6,408,577 | B1 * | 6/2002 | Desjoyaux et al. | 52/182 |
| 7,171,786 | B2 * | 2/2007 | George | 52/107 |
| 7,232,009 | B1 * | 6/2007 | White et al. | 182/37 |
| 7,958,692 | B2 * | 6/2011 | George | 52/745.2 |
| 8,177,028 | B2 * | 5/2012 | Durkin | 182/106 |
| 2003/0042074 | A1 * | 3/2003 | Van Gilst | 182/93 |
| 2003/0167705 | A1 * | 9/2003 | Oakley | 52/107 |
| 2004/0261343 | A1 | 12/2004 | Koteskey | |
| 2005/0082117 | A1 * | 4/2005 | Morral Gispert | 182/93 |
| 2007/0095610 | A1 * | 5/2007 | Grundler | 182/93 |

FOREIGN PATENT DOCUMENTS

| | | |
|---|---|---|
| JP | 2001-164856 | 6/2001 |
| JP | 2002-038504 | 2/2002 |
| SU | 1067218 | 1/1984 |
| SU | 1182848 | 4/1987 |
| WO | 95/06185 | 3/1995 |

* cited by examiner

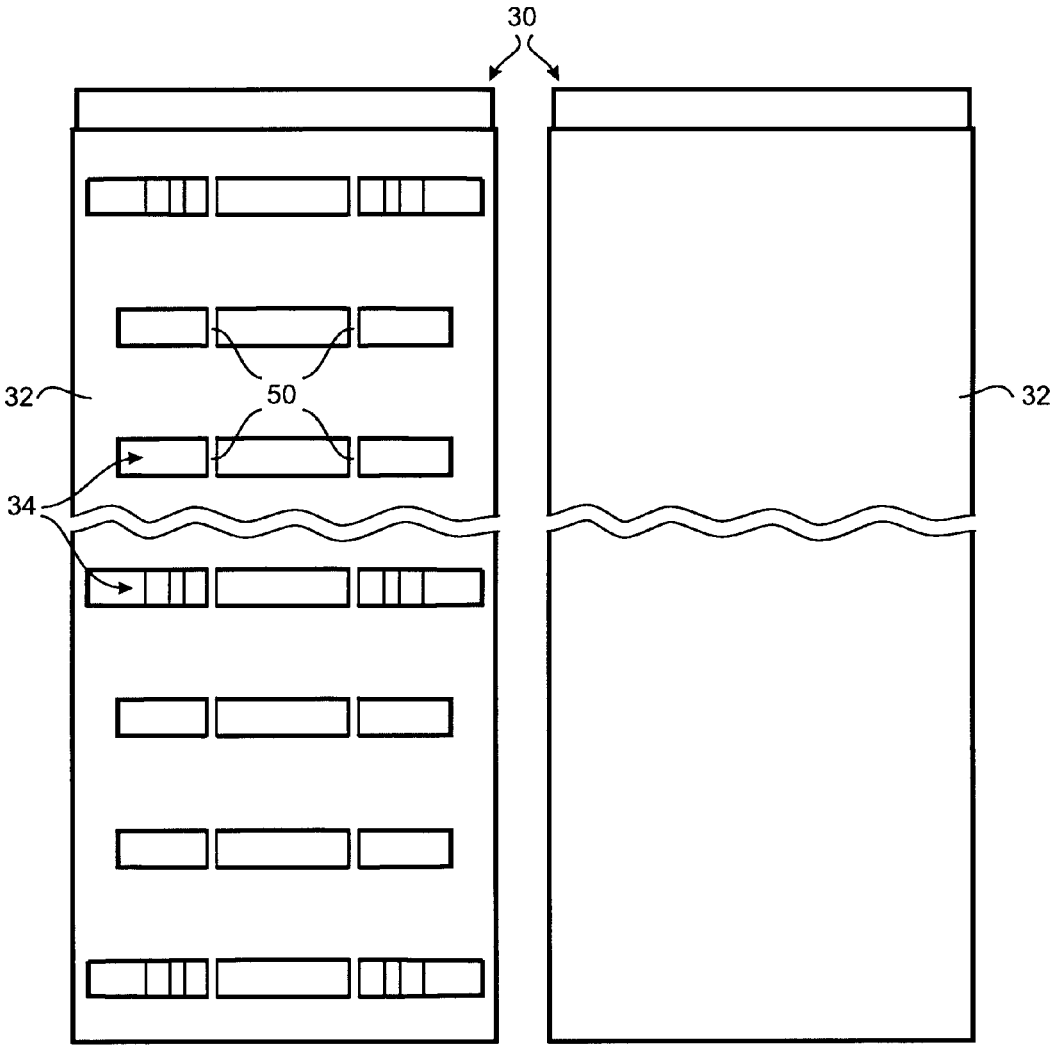
Fig 11
Fig 12
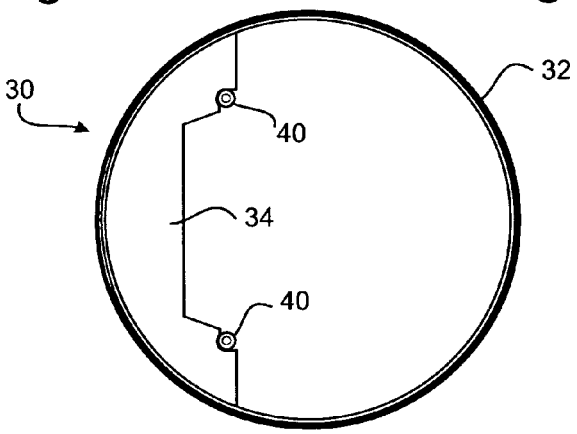
Fig 13

LADDERWAY SYSTEM FOR UNDERGROUND RAISES

FIELD OF THE INVENTION

The present invention relates to an improved ladderway system for underground raises and relates particularly, though not exclusively, to an improved ladderway system for underground mine development.

BACKGROUND TO THE INVENTION

Underground mines are required to provide ventilation raises, which may also serve as emergency escape raises through which underground miners can escape to the surface in the event of an emergency. For this purpose it is common for such underground escape raises to be provided with a ladderway to permit miners to climb up out of the mine. Conventional ladderways are typically in the form of a prefabricated steel ladder surrounded with a steel mesh caging to provide a measure of protection for the miners as they climb the ladder.

Apart from the fact that such steel ladderways are heavy and expensive to manufacture and install, they are also difficult and expensive to maintain. The ladderway is constantly exposed to groundwater and seepage which contribute to corrosion, particularly in highly saline groundwater conditions. Hence such steel ladderways require regular maintenance to ensure that salt and rust forming on the ladder rungs are cleaned away. It is difficult to ascertain to what extent the steel has corroded over time and the safety of the ladderway is compromised. Furthermore, the steel mesh cage does not provide adequate protection for miners from rock falls.

Commonly owned International Application No PCT/AU2005/001815 describes a ladderway system for an underground raise, the system comprising an elongate tube with a ladder mechanically coupled to an interior of the tube. The tube is of circular cross-section and is formed with a longitudinal slit along its entire length whereby the diameter of the tube can be adjusted to conform to the shape of the raise. Both the tube and the ladder are typically made from a suitable plastics material. The ladder is used for mounting both the ladder and the tube to a wall of the raise. Whilst this system operates quite well, it is rather cumbersome to install. Furthermore the manufacture and installation of the ladder and the tube as separate components detracts from the modular design of the system.

The present invention was developed with a view to providing an improved ladderway system that provides improved safety for miners escaping through a raise from an underground mine, but may also be applicable in other situations where a ladderway is required to provide an escape way in a relatively confined space.

References to prior art documents in this specification are provided for illustrative purposes only and are not to be taken as an admission that such prior art is part of the common general knowledge in Australia or elsewhere.

SUMMARY OF THE INVENTION

According to one aspect of the present invention there is provided an improved ladderway system for an underground raise, the system comprising:

an elongate tube made of a suitably rigid plastics material and adapted to be received in the raise, the tube having a series of steps moulded into an interior side wall thereof so as to form a ladder extending substantially the full length of the tube.

Advantageously said elongate tube is of circular cross-section and each step is in the form of a generally planar platform protruding inwards from the interior side wall of the tube. Preferably an outer edge of each step is substantially straight and is formed on a chord of the circular cross-section of the tube. Preferably the outer edge of each step is provided with a tread grip.

Preferably each of the steps has a hollow interior and is formed with a pair of gussets within the hollow interior to provide additional strength and rigidity.

Preferably the ladder of the improved ladderway system further comprises a pair of elongate handrails adapted to be attached to the steps and extending substantially the full length of the tube. Typically each handrail is in the form of a substantially rigid member of circular cross-section having an outside diameter that can be readily gripped by a person's hand. Preferably the handrails are manufactured from a similar suitably rigid plastics material as the tube. Preferably each handrail is formed with a protruding portion of reduced diameter at a top end, which is adapted to be received in a matching recess provided in a bottom end of a corresponding handrail on an adjacent tube.

Preferably the ladderway system is a modular system and the elongate tube is one of a plurality of elongate tubes adapted to be joined end to end in the raise. Preferably each of the tubes is tapered at one end so that the ends of adjacent tubes can overlap when joined end to end.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention. Furthermore, throughout the specification, unless the context requires otherwise, the word "raise" will be understood to refer to any vertical or angled underground development opening or shaft that can be used for ventilation, materials handling or as a manway including, but not limited to, winzes and rises.

BRIEF DESCRIPTION OF THE DRAWINGS

The nature of the invention will be better understood from the following detailed description of a preferred embodiment of the improved ladderway system, given by way of example only, with reference to the accompanying drawings, in which:

FIG. 3(*b*) is the same view as FIG. 3(*a*) but with the handrails shown on the Figure;

FIG. 11 is a front elevation of the ladderway system of FIG. 8;

FIG. 12 is a rear elevation of the ladderway system of FIG. 8; and,

FIG. 13 is a top plan view of the ladderway system of FIG. 8

DETAILED DESCRIPTION OF PREFERRED EMBODIMENTS

A first embodiment of the improved ladderway system 10 in accordance with the invention, as illustrated in FIGS. 1 to 6, comprises an elongate tube 12 made of a suitably rigid plastics material and adapted to be received in a raise. The tube 12 has a series of steps 14 moulded into an interior side wall of the tube 12 so as to form a ladder extending substantially the full length of the tube 12. Mounting means for mounting the tube to a wall of the raise are also provided (see FIG. 7). In use, the tube 12 acts to protect a person on the ladder from falling rocks, and so on.

Figure 1:
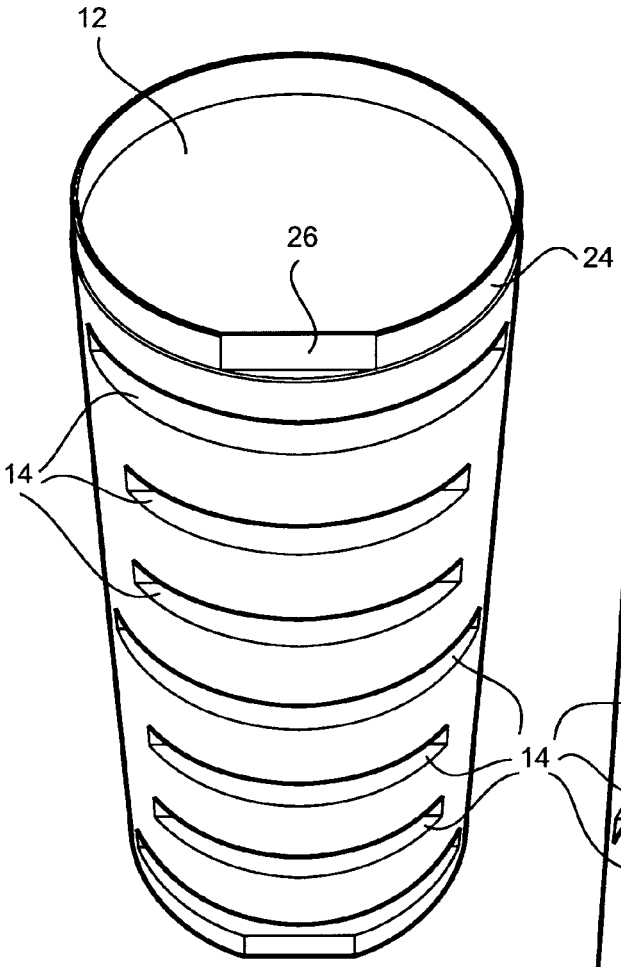
FIG. 1 is a top perspective view of a first embodiment of the improved ladderway system in accordance with the invention.
Figure 2:
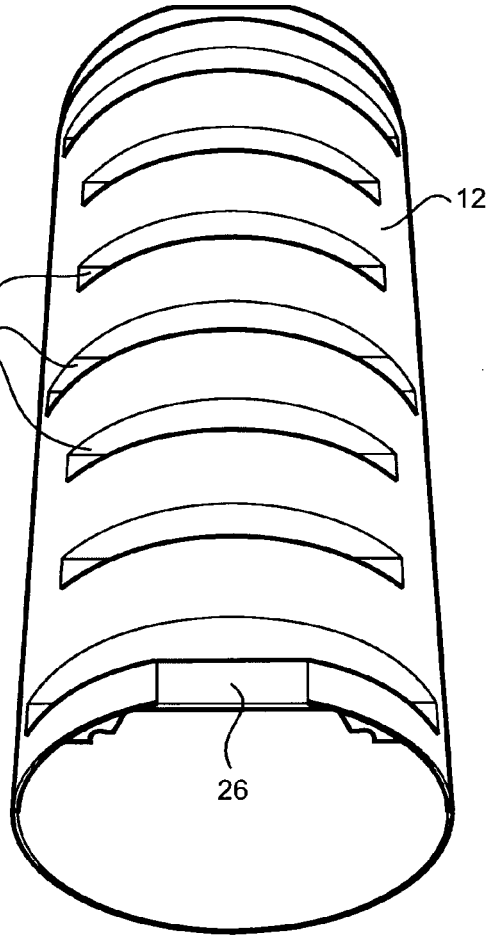
FIG. 2 is a bottom perspective view of the improved ladderway system of FIG. 1.
Figure 3A:
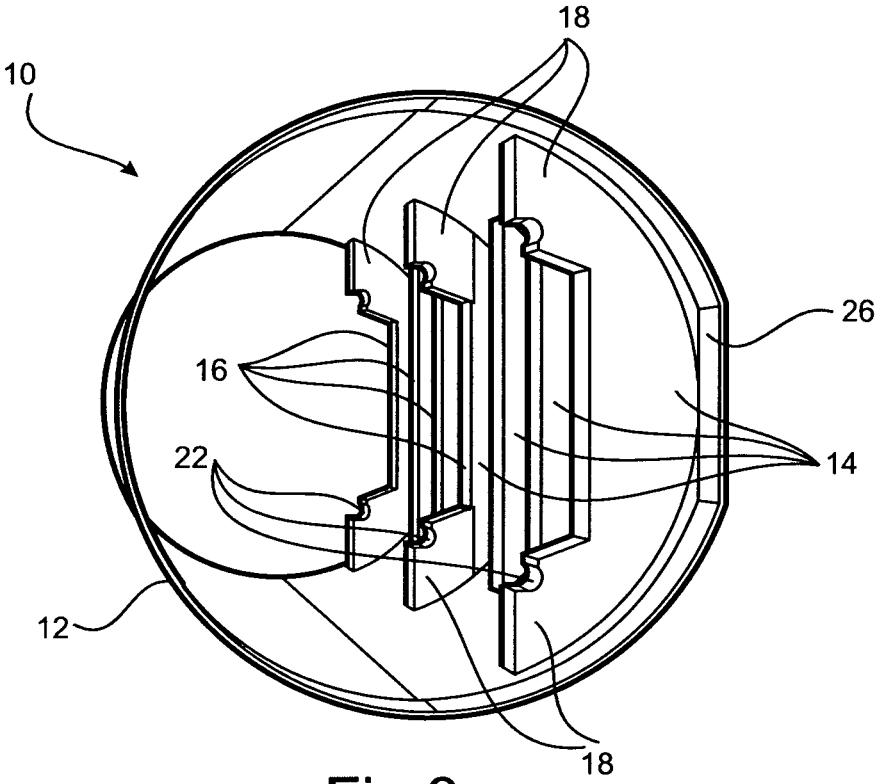
FIG. 3(*a*) is a top vertical perspective view of the improved ladderway system of FIG. 1.
Figure 3B:
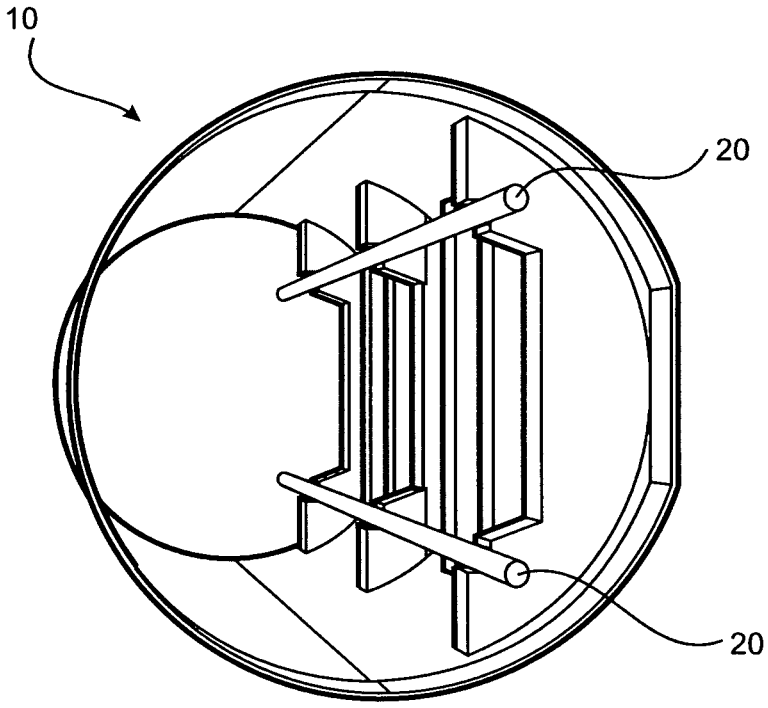
Figure 4:
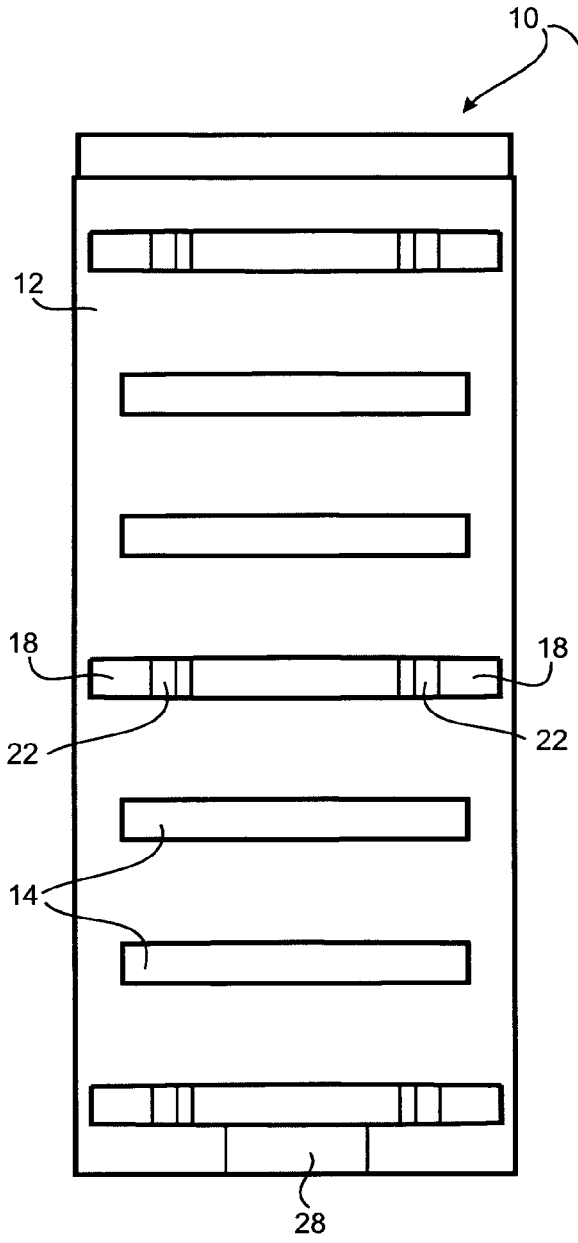
FIG. 4 is a front elevation of the ladderway system of FIG. 1.
Figure 5:
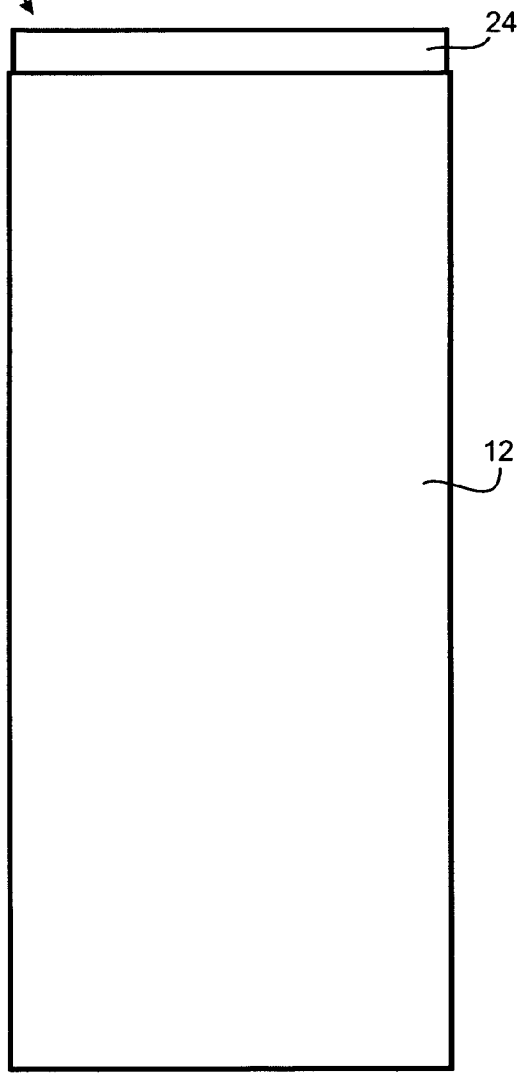
FIG. 5 is a rear elevation of the ladderway system of FIG. 1.
Figure 6:
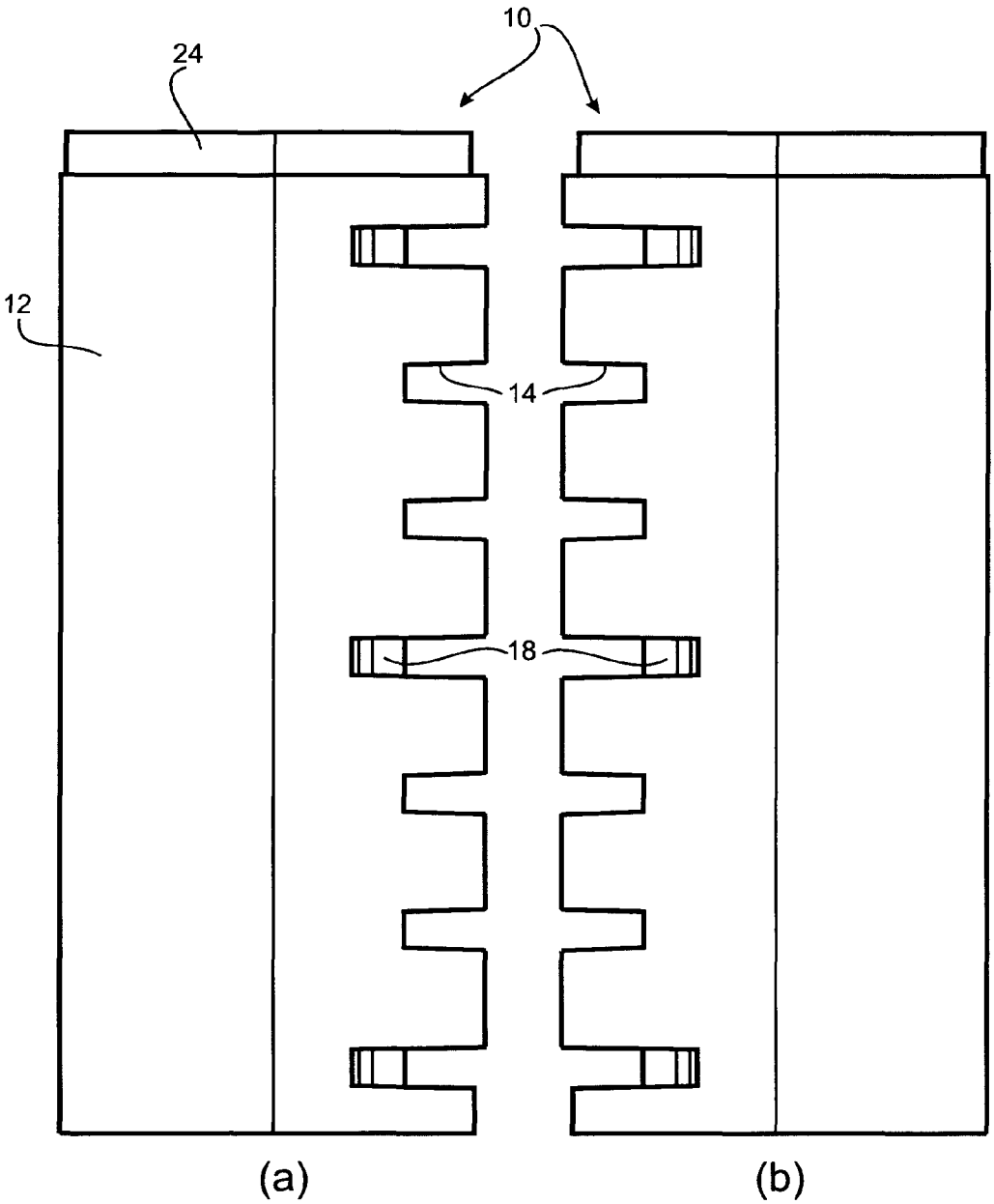
FIGS. 6 (*a*) and (*b*) are left and right elevations respectively of the ladderway system of FIG. 1.

As can be seen most clearly in FIG. 3(*a*), the elongate tube 12 is of circular cross-section and each step 14 is in the form of a generally planar platform protruding inwards from the interior side wall of the tube 12. Preferably an outer edge 16 of each step 14 is substantially straight and is formed on a chord of the circular cross-section of the tube 12. Preferably the outer edges 16 of all of the steps 14 are substantially vertically aligned.

Preferably the ladder of the improved ladderway system 10 further comprises a pair of handrails 20 (shown in FIG. 3(*b*)) adapted to be attached to the steps 14. The handrails 20 extend substantially the full length of the tube 12. Typically each handrail 20 is in the form of a substantially rigid member of circular cross-section having an outside diameter that can be readily gripped by, a person's hand. The handrails 20 are preferably manufactured from a similar suitably rigid plastics material as the tube 12.

As can be seen most clearly in FIG. 3(*a*), a plurality of the steps 14 are formed with a pair of enlarged side wings 18. The side wings 18 are each formed with a recess 22 for receiving the respective handrails 20 therein. In the illustrated embodiment the recesses 22 are formed of semi-circular cross-section with an inside diameter matching the outside diameter of the handrails 20. The handrails 20 are typically fastened in the recesses 22 by thermoplastic welding and/or a suitable plastics adhesive and/or nuts and bolts.

Figure 7:
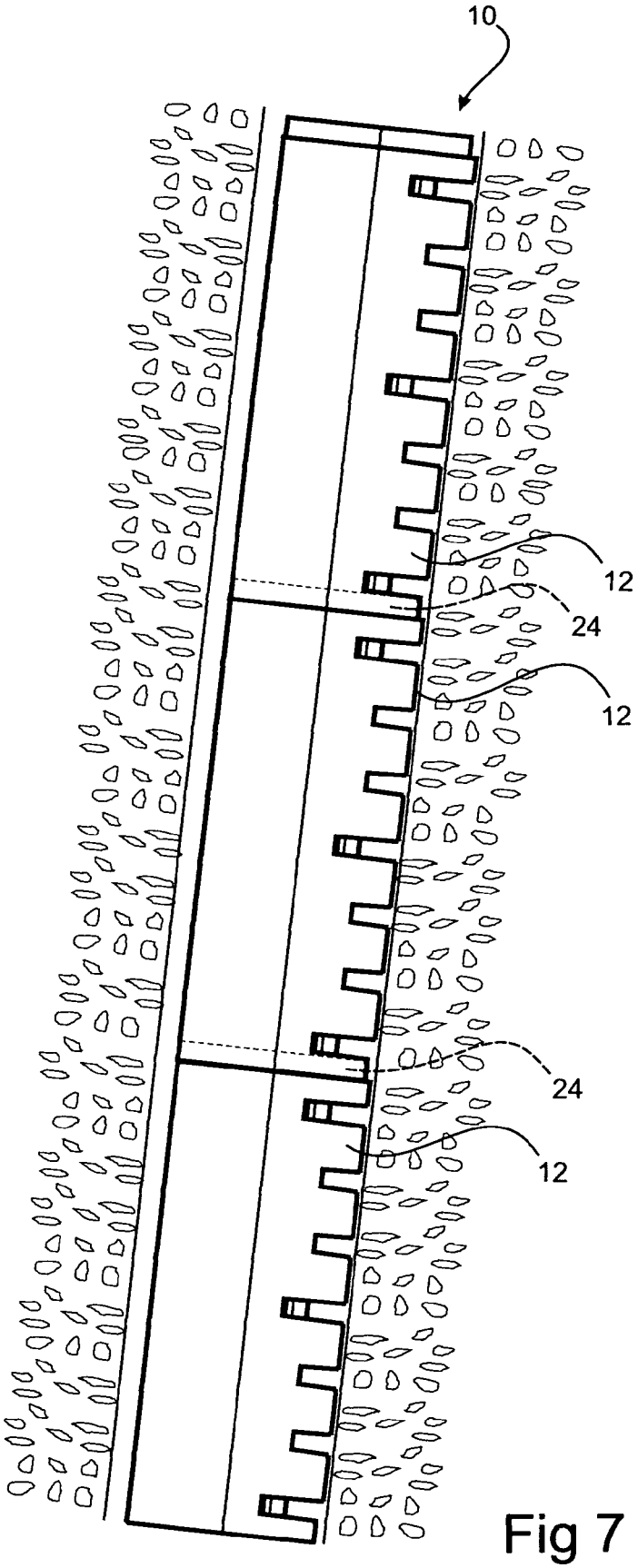
FIG. 7 illustrates the improved ladderway system of FIG. 1 installed in a raise.
Figure 8:
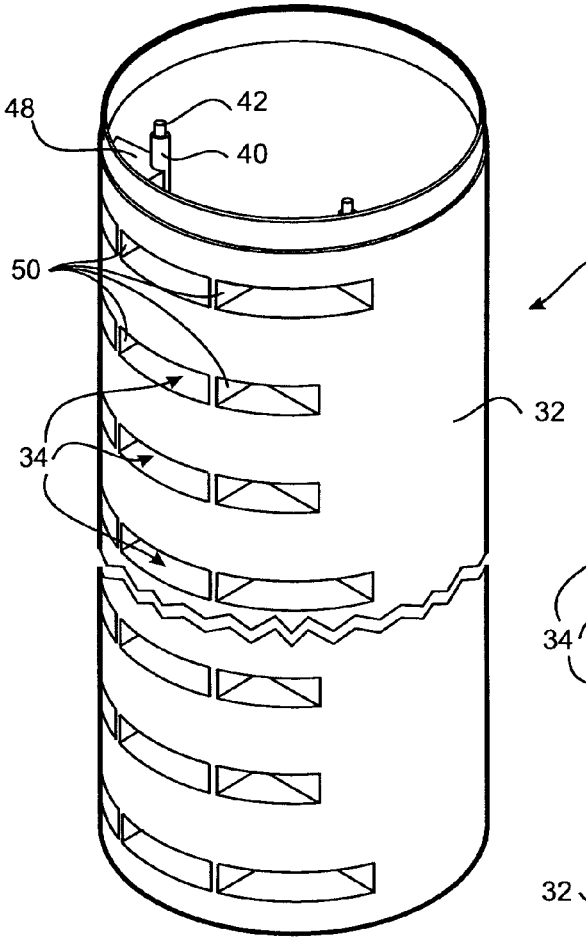
FIG. 8 is a top perspective view of a second embodiment of the improved ladderway system in accordance with the invention.
Figure 9:
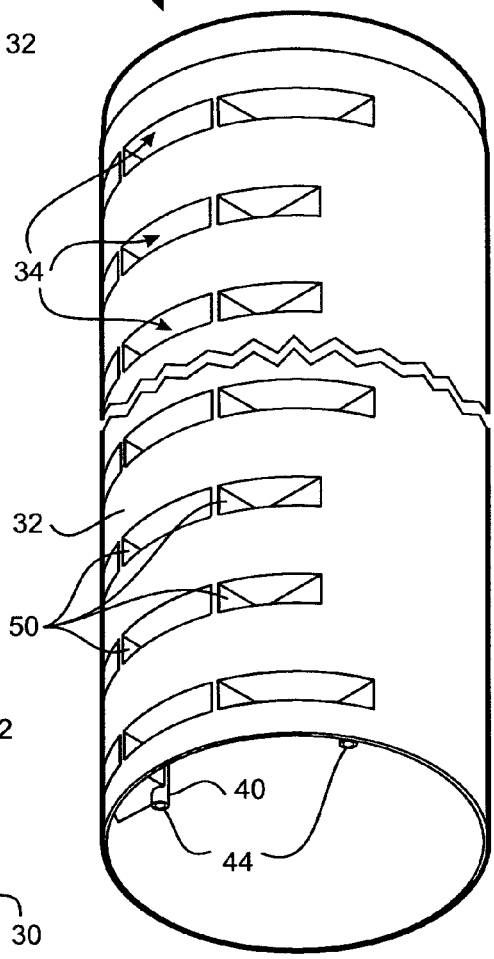
FIG. 9 is a bottom perspective view of the improved ladderway system of FIG. 8.

Preferably the ladderway system 10 is a modular system and the elongate tube is one of a plurality of elongate tubes 12 adapted to be joined end to end in the raise, as shown in FIG. 7. For this purpose, each of the tubes 12 has a taper 24 at the top end so that the ends of adjacent tubes 12 can overlap when joined end to end. Advantageously the taper 24 has a first planar section 26 which matches a corresponding second planar section 28 provided at the base of the tube 12. The two planar sections 26 and 28 align so as together to form an interlock with an adjoining tube 12. The interlock ensures that when the tubes 12 are joined end-to-end, the steps 14 of the respective tubes 12 will always align so as to form a continuous ladder throughout the length of the ladderway system 10.

Each tube 12 of the illustrated embodiment is approximately 2.1 meters in length and is joined to an adjacent tube 12 by welding or bolting. Typically there are seven steps 14 moulded into the interior side wall of each tube 12. Preferably three of the steps 14, spaced apart at equal intervals, are formed with the side wings 18. This spacing ensures that the handrails 20 have sufficient support to be mounted securely in the tube 12, whilst allowing a user to maintain his or her grip on the handrails while climbing without having to release the handrails completely at every step in order move the hands along the handrails.

A second embodiment of the improved ladderway system 30 in accordance with the invention, as illustrated in FIGS. 8 to 12, is similar to the first embodiment in that it comprises an elongate tube 32 made of a suitably rigid or resilient plastics material and adapted to be received in a raise. The tube 32 has a series of steps 34 moulded into an interior side wall of the tube 32 so as to form a ladder extending substantially the full length of the tube 32.

Figure 10:
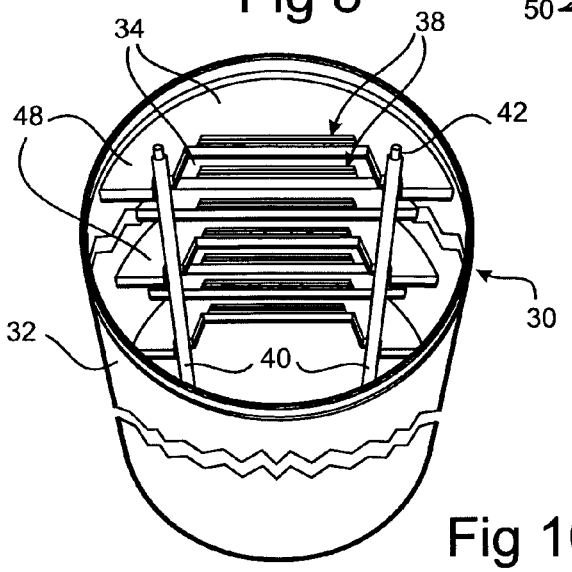
FIG. 10 is a top vertical perspective view of the improved ladderway system of FIG. 8.

As with the first embodiment, the elongate tube 32 is of circular cross-section and each step 34 is in the form of a generally planar platform protruding inwards from the interior side wall of the tube 32 (see FIGS. 10 and 13). Preferably an outer edge 36 of each step 34 is substantially straight and is formed on a chord of the circular cross-section of the tube 32. Advantageously the outer edges 36 of all of the steps 34 are substantially vertically aligned, as can be seen most clearly in FIG. 13. Preferably the outer edge 36 of each step is provided with a tread grip 38 to provide a surer footing and inhibit slipping.

As with the first embodiment, the ladder of the improved ladderway system 30 further comprises a pair of handrails 40 adapted to be attached to the steps 34. The handrails 40 extend substantially the full length of the tube 32. The handrails 40 and similar to the handrails 20 of the first embodiment, except that in this embodiment each handrail 40 is formed with a protruding portion 42 of reduced diameter at the top end, which is adapted to be received in a matching recess 44 provided in the bottom end of a corresponding handrail on an adjacent tube 32. When adjacent tubes 32 of the improved ladderway system 30 are properly aligned, the protruding portions 42 at the respective tops of the handrails 40 are received in the matching recesses 44 provided in the bottom ends of the respective handrails 40, to provide two continuous handrails extending from the top to the bottom of the ladderway system 30.

Advantageously the handrails 40 are spaced apart a sufficient distance to permit an emergency services stretcher to be received between the handrails, for example, when it is necessary to lift an injured miner up through the raise. Because the outer edges 36 of all of the steps 34 are substantially vertically aligned, a stretcher can readily slide along, and is supported by, the outer edges 36 of steps 34 as it is lifted.

As with the previous embodiment, there are seven steps 34 moulded into the interior side wall of each tube 32. Three of the steps 34, spaced apart at equal intervals, are formed with side wings 48. Unlike the previous embodiment, each of the steps 34 is formed with a pair of gussets 50 in the hollow interior space of the step, as can be seen most clearly in FIGS. 8 and 9. The gussets 50 are generally planar and extend substantially perpendicularly from the outer edge 36 of each step 34 to the outer circumference of the tube 32. The gussets 50 provide additional strength and rigidity to the steps 34 and the tube 32.

In other respects the ladderway system 30 is similar to the first embodiment 10. The tubes of the ladderway system 10 or 30, with the steps moulded integral therewith, can be readily mass-produced by a suitable plastics moulding process such as, for example, rotamoulding.

Now that preferred embodiments of the improved ladderway system have been described in detail, it will be apparent that it provides a number of advantages over the prior art, including the following:

(i) Due to its unitary construction it is much easier to manufacture and install than prior art systems.

(ii) Due to its relatively lightweight construction it is easier to transport and handle.

(iii) Due to its modular construction it can be used to provide any desired length of ladderway. Longer lengths, in particular, are simpler and easier to install.

(iv) Because the system is manufactured substantially entirely of plastics materials it will not corrode like prior art steel ladderways.

(v) The tube of the ladderway system provides improved safety and comfort for personnel and also protects the ladder from groundwater and seepage.

(vi) It is relatively inexpensive to manufacture and can be assembled and installed without the need for expensive steel welding equipment or a large crane.

(vii) The moulding of the steps to the interior of the tube prevents the potential safety issue of the ladder coming away from the tube when the ladder is provided as a separate component which is affixed to the tube.

It will be readily apparent to persons skilled in the relevant arts that various modifications and improvements may be made to the foregoing embodiments, in addition to those already described, without departing from the basic inventive concepts of the present invention. For example, the shape and configuration of the tube and the steps may vary considerably from that shown in the accompanying drawings. For instance, the tube could be made of rectangular or elliptical cross-section. Therefore, it will be appreciated that the scope of the invention is not limited to the specific embodiments described but is to be determined from the appended claims.

The invention claimed is:

1. An improved ladderway system for an underground raise, the system comprising:

an elongate tube made of a substantially rigid plastic material and adapted to be received in the raise, the tube having a series of steps moulded into an interior side wall thereof so as to form a ladder extending substantially a full length of the tube, each step comprising a generally planar platform protruding inwardly from the interior side wall of the tube;

a pair of elongate handrails attached to the steps and extending substantially the full length of the tube; and, wherein a plurality of the steps are each formed with a pair of enlarged side wings, each of the side wings of the pair of enlarged side wings is moulded with a recess for receiving a respective handrail of the pair of elongate handrails therein, and wherein the plurality of the steps formed with the pair of enlarged side wings is less than the total number of steps so that the recesses for receiving the respective handrails are provided at spaced vertical intervals which are larger than spaced vertical intervals between adjacent steps when in use.

2. The improved ladderway system as defined in claim 1, wherein the pair of enlarged side wings is provided on every second step.

3. The improved ladderway system as defined in claim 1, wherein each handrail is in the form of a substantially rigid member of circular cross-section having an outside diameter that can be gripped by a person's hand.

4. The improved ladderway system as defined in claim 3, wherein each handrail is formed with a protruding portion of reduced diameter at a top end, which is adapted to be received in a matching recess provided in a bottom end of corresponding handrail on an adjacent tube.

5. The improved ladderway system as defined in claim 3, wherein the handrails are manufactured from a substantially rigid plastic material.

6. The improved ladderway system as defined in claim 1, wherein the ladderway system is a modular system and the elongate tube is one of a plurality of elongate tubes adapted to be joined end to end in the raise.

7. The improved ladderway system as defined in claim 6, wherein each of the tubes is tapered at one end so that the ends of adjacent tubes can overlap when joined end to end.

8. The improved ladderway system as defined in claim 7, wherein the taper provided on each tube has a planar section which is adapted to interlock with a matching planar section on an adjoining tube to ensure that the tubes are vertically aligned.

* * * * *